US005849050A

United States Patent [19]

Wolf

[11] Patent Number: 5,849,050

[45] Date of Patent: Dec. 15, 1998

[54] PROCESS FOR GENERATING BURNABLE GAS

[75] Inventor: Bodo Wolf, Freiberg, Germany

[73] Assignee: CRG Kohlenstoffrecycling Ges.mbH, Freiberg, Germany

[21] Appl. No.: 693,167

[22] PCT Filed: Feb. 8, 1995

[86] PCT No.: PCT/EP95/00443

§ 371 Date: Aug. 14, 1996

§ 102(e) Date: Aug. 14, 1996

[87] PCT Pub. No.: WO95/21903

PCT Pub. Date: Aug. 17, 1995

[30] Foreign Application Priority Data

Feb. 15, 1994 [DE] Germany ..... 44 04 673.1

[51] Int. Cl.[6] ..... C10J 3/00; C10J 3/16; F02B 43/00

[52] U.S. Cl. ..... 48/197 R; 48/73; 48/111; 48/202; 48/209; 60/39.12

[58] Field of Search ..... 48/73, 111, 197 R, 48/202, 209; 60/39.12

[56] References Cited

U.S. PATENT DOCUMENTS 4,142,867 3/1979 Kiener ..... 48/76
5,290,327 3/1994 Rossle ..... 48/111

FOREIGN PATENT DOCUMENTS 0 563 777 10/1993 European Pat. Off. .
41 39 512 6/1993 Germany .

OTHER PUBLICATIONS

Lynch, "Clean Coal Technology Commercial–Size IGCC Demonstration Plants", VGB–Tagungsbericht Feuerungen 1994, TB 217, Vortrag $D_3$, pp. 1–14.
Hanai et al., Current Status of 200T/D IGCC Pilot Plant at Nakoso, Engineering Research Associate For Integrated Coal Gasification Combined Cycle Power Systems, Jul. 1992, pp. 1–16.

*Primary Examiner*—Ardin H. Marschel
*Assistant Examiner*—Jezia Riley
*Attorney, Agent, or Firm*—Foley & Lardner

[57] ABSTRACT

A process is disclosed for generating burnable gas by gasifying water- and ballast-containing organic materials, be it coal or garbage. The drying, low temperature carbonization and gasification steps are carried out separately. The heat taken form cooled gasified gas is supplied to the endothermic drying low temperature in low temperature carbonation stages. The low temperature carbonization gas is burned in a melting chamber furnace with air and/or oxygen or oxygen-rich flue gas and the liquid slag is evacuated, whereas the low temperature carbonization coke is blown into the hot combustion gases that leave the melting reactions which take place and give carbon monoxide and hydrogen reduce the carbon is removed from the gasified gas, supplied to the melting chamber furnace and completely burned. The advantage of the invention is that the ashes may be transformed into an elution-resistant granulated building material, in that a tar-free burnable gas is generated and in that oxygen consumption is strongly reduced in comparison with the fly stream gasification process.

13 Claims, 1 Drawing Sheet

PROCESS FOR GENERATING BURNABLE GAS

BACKGROUND OF THE INVENTION

1. Field of the Invention

The invention relates to a process for generating burnable gas from water- and ballast-containing organic materials, such as coal, municipal and industrial sludges, wood and biomasses, municipal and industrial refuse and waste and waste products, residues and other materials.

The invention can be used in particular for utilizing the energy of biomasses and wood from agricultural areas planted cyclically, in particular recultivated mining areas, and thus for providing for the carbon-dioxide-neutral conversion of natural fuels into mechanical energy and heat energy and for the productive disposal of municipal, commercial, agricultural and industrial refuse, other organic wastes, residues, byproducts and waste products.

2. Description of Related Art

The prior art is characterized by a number of proposals and practical applications for utilizing the energy of plants and organic wastes and municipal, commercial, industrial and agricultural refuse. A seminar run in November 1981 by the Kernforschungsanlage Jüalich GmbH [Jülich Nuclear Research Establishment] summarized the prior art on the thermal generation of gas from biomass, i.e. gasification and degasification, which still today substantially characterizes the prior art (report of the Kernforschungsanlage Jüalich-J üilConf-46). Accordingly, processes for combustion, degasification and gasification, alone or in combination, define the prior art with the following aims: production of combustion gas as a source of heat energy for steam generation by combustion,—production of highly caloric solid and liquid fuels, such as coke, charcoal and liquid, oil-like tars by low-temperature carbonization, degasification and gasification,—production of burnable gas by complete gasification, avoiding solid and liquid fuels.

In the gasification processes, the procedure determines whether the liquid and high-molecular low-temperature carbonization products are obtained or are likewise gasified by oxidation.

The oldest type of gasification is fixed-bed gasification, fuel and gasification medium being moved in countercurrent to one another. These processes achieve maximum gasification efficiency with the minimum oxygen consumption. The disadvantage of this type of gasification is that the fuel moisture and all known liquid low-temperature carbonization products are present in the gasification gas. In addition, this type of gasification requires fuel in piece form. Fluidized-bed gasification, known as Winkler gasification, very largely, but not completely, eliminated this deficiency of fixed-bed gasification. In the gasification of the bituminous fuels, the necessary freedom from tar, for example, of the gasification gas, as is required for using the gas as a fuel for internal combustion engines, is achieved. Furthermore, because of the higher mean temperature level in the procedure, in comparison with the fixed-bed gasification, the oxygen consumption is markedly higher. In addition, the temperature level of the Winkler gasification means that the majority of the input carbon is not converted into burnable gas, but is discharged again in the form of dust, and is discharged from the process bound to the ash. This deficiency in the gasification technology can be avoided by the high-temperature entrained-bed gasification processes, which generally operate above the melting point of the ash.

An example of these is DE 41 39 512 A1. In this process, waste materials are broken down by low-temperature carbonization into low-temperature carbonization gas and low-temperature carbonization coke and thus processed into a form necessary for gasification in an exothermic entrained-bed gasifier. The conversion to the exothermic entrained-bed gasifier is associated with further increasing oxygen consumption and decreasing efficiency, although the organic matter of the waste materials is virtually completely converted into burnable gas. The reasons for this lie in the high temperature level of these gasification processes, which cause the majority of the heat generated by the fuel to be converted into physical enthalpy of the burnable gas.

The deficiency in these technical solutions, as also affects DE 41 39 512, was of course recognized internationally by those skilled in the art and responded to with novel solution proposals. The most recent prior art coal gasification is characterized in that a part-stream of the coal is burnt in a slag-tap furnace to give hot combustion gas which is used as gasification medium in the continuation of the process. Introducing the second coal part-stream into the hot gasification medium creates the preconditions for an endothermic gasification, and the combustion gas is converted into burnable gas using the Boudard reaction and water gas reaction. This type of gasification is used in practice in Japan in the NEDO Project and in the USA in the WABASH RIVER Project. This type of gasification is not suitable for wood, residues and refuse, since these materials can only be converted with great mechanical outlay into the dust form necessary for this procedure.

DE 42 09 549 remedies this deficiency, by connecting a pyrolysis stage for thermal processing of the fuels, in particular waste materials, upstream of the combination part- stream combustion/endothermic entrained-bed gasification. However, this process has the deficiency that in this case the hot gasification medium is prepared by burning the pyrolysis coke with air and/or oxygen and the low-temperature carbonization gas containing olefins, aromatics etc., is used for the reduction.

However, experience of several years of operating gasifying plants in practice indicates that burnable gases containing olefin and aromatics cannot be converted, at temperatures up to 1500° C. and in an endothermic procedure, into tar-free burnable gas, as required for use as burnable gas for gas turbines and engines. The essential deficiency of this procedure is, therefore, that, in the course of the necessary gas cooling and processing, aqueous gas condensates are produced which cannot be released into the environment in this form, so that considerable outlay is required for their treatment.

SUMMARY OF THE INVENTION

The aim of the invention is to propose a process for gasifying organic materials, in particular water- and ballast-containing materials, which provides the inorganic portion of these materials at a vitrified, elution-resistant product and converts the organic matter of these materials to tar-free burnable gas, which can also be processed to give synthesis gas, with, in comparison with the entrained-bed gasification of the prior art, lower consumption of oxygen-containing gasification medium, and higher gasification efficiency, based on the chemical enthalpy of the burnable gas produced.

The technical object of the invention to be achieved is to convert a portion of the physical enthalpy, which is necessary to achieve the temperature level above the melting point of the inorganic portion of the materials to be gasified, back into chemical enthalpy in the course of the process.

According to the invention this is achieved by means of the fact that, under pressures of 1 to 50 bar, in a first process stage, the ballast-rich organic materials containing their organic and water portions are dried by direct or indirect supply of physical enthalpy of the gasification gas and are subjected to low-temperature carbonization at 350° to 500° C., and are thus thermally decomposed into low-temperature carbonization gas, which contains the liquid hydrocarbons and the steam, and coke, which principally contains carbon, in addition to the inorganic portion, second process stage, the low-temperature carbonization gas is burnt with air and/or oxygen, oxygen-containing exhaust gases, e.g. from gas turbines or internal combustion engines, at temperatures above the melting temperature of the inorganic portion of the organic materials, preferably at 1200° to 2000° C., with removal of molten inorganic portion, at an excess air number of 0.8 to 1.3, based on the theoretical air requirement for complete combustion, in a third process stage, the combustion gas from the second process stage is converted into gasification gas and the gas temperature is decreased to 800° to 900° C., by blowing low-temperature carbonization coke from the first process stage, if appropriate ground to give pulverized fuel, into the combustion gas at 1200° to 2000° C., which coke partially reduces the carbon dioxide to carbon monoxide and partially reduces the steam to hydrogen, with consumption of heat, fourth process stage, the gasification gas from the third process stage, if appropriate after indirect and/or direct cooling, is processed to give burnable gas, by dedusting it and chemically cleaning it, and feeding the dust which still contains carbon, which is produced in the course of this process, to the combustion of the low-temperature carbonization gas in the second process stage.

DETAILED DESCRIPTION OF A PREFERRED EMBODIMENT

Figure 1:
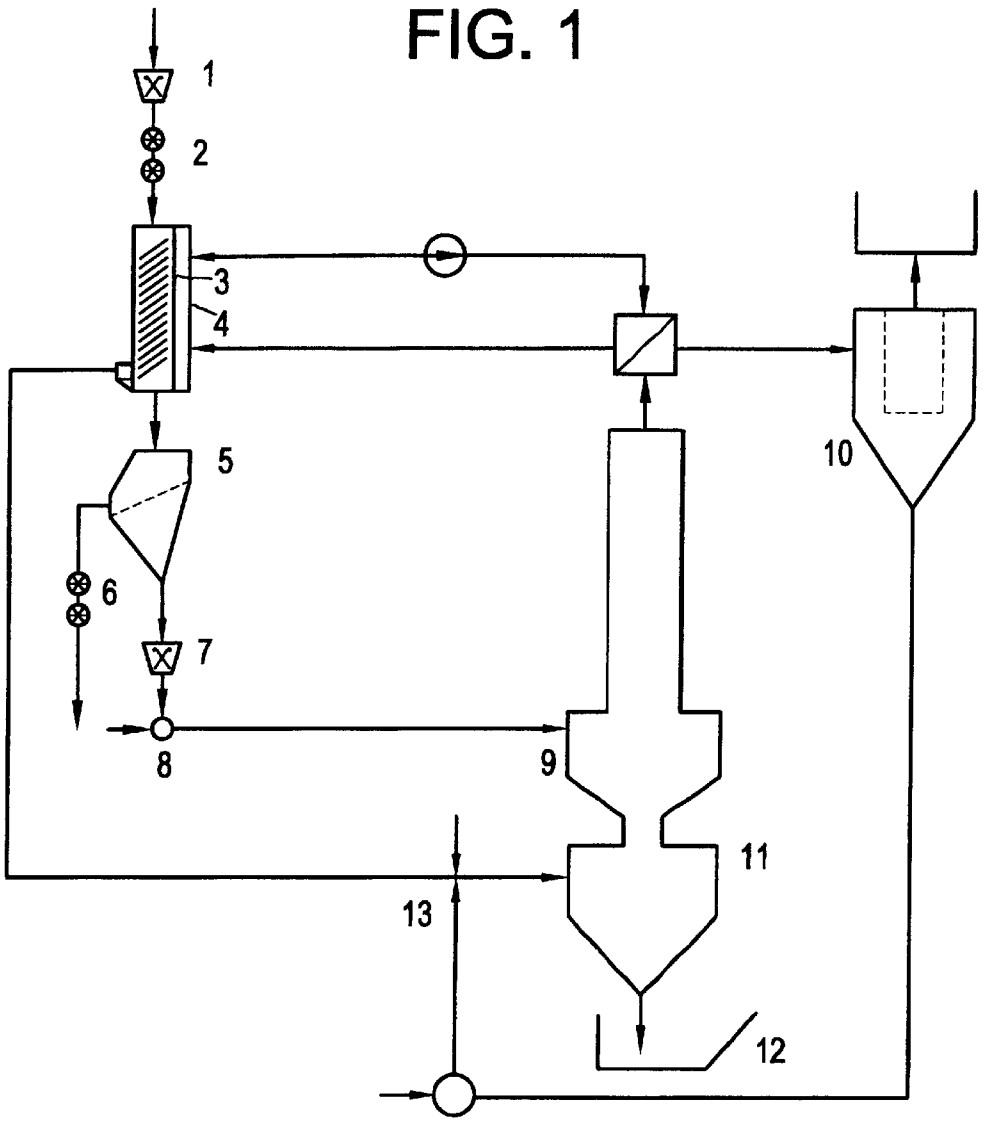
FIG. 1 is a an outline technical diagram in accordance with the present invention.

The efficiency of the invention lies in the fact that the inorganic matter of ballast-containing organic materials is converted into a vitrified elution-resistant building material, with decrease of the consumption of oxygen-containing gasification medium to the level of the fluidized-bed gasification and complete gasification of the organic matter at a temperature level which corresponds to the Winkler gasification and a higher gasification efficiency in comparison with the prior art, measured by the chemical enthalpy of the burnable gas.

Working example

The invention is described with the aid of the outline technological diagram shown in FIG. 1 and subsequent numerical estimation.

The starting material used is a water- and ballast-containing organic material, a refuse-containing biomass of the following composition (in kg/tonne):

| Constituent | Mass |
|---|---|
| Carbon | 250 |
| Hydrogen | 25 |
| Oxygen | 150 |
| Nitrogen | 8 |
| Sulfur | 2 |
| Heavy Metals (Pb, Cd, Hg, Cu, Sn) | 3 |
| Ash | 100 |
| Iron/nonferrous metal | 30 |
| Glass/minerals | 112 |
| Water | 320. |

This starting material is comminuted in a shredder (1) to an edge length of 20 to 50 mm and introduced via a gastight lock system (2) into an indirectly heated low-temperature carbonization chamber (3), operating under atmospheric pressure, in which the starting material is mechanically agitated as necessary. Owing to the indirect heat supply (4), the starting material dries and carbonizes, and in the course of this it decomposes at a final temperature of 40° to 500° C. into approximately 405 kg of solid, which approximately comprises 40% carbon, whereas the remainder is composed of minerals, glass, iron and nonferrous metals and heavy metals and ash, and 595 kg of low-temperature carbonization gas, approximately two thirds of which comprises steam, and contains all other known liquid and gaseous low-temperature carbonization products.

The solids from the low-temperature carbonization are separated under low-temperature carbonization gas in a screen (5) into a coarse fraction, which principally contains minerals, glass and metal scrap, having an edge length greater than 5 mm, and a fine-grain carbon source. The coarse fraction is discharged from the process via gastight lock systems (6) and, if appropriate, is fed through a separator. The carbon source remains in the system and is fed to a reduction chamber (9) via a continuous mill (7) and via a pneumatic transport system (8), which uses the recycled burnable gas as transport medium. The inorganic portion of the carbon source is removed in a gas dedusting stage (10) together with the carbon not consumed in the reduction chamber (9) and is fed together with the low-temperature carbonization gas produced in the low-temperature carbonization chamber (3) to a slag-tap furnace (11) and is burned there with oxygen above the melting temperatures of the inorganic matter of the carbon source. The liquid slag produced in the course of this process is discharged into a water bath (12) and removed from the process from there as elution-resistant building material granules. The combustion gas which is at 1200° to 2000° C. passes from the slag-tap furnace (11) to the reduction chamber (9), where some of its carbon dioxide and steam chemically reacts endothermically with the carbon source to give carbon monoxide and steam, which decreases the gas temperature to 800° to 900° C. The carbon-containing dust produced in the gas dedusting (10) is likewise fed to the slag-tap furnace (11) by a pneumatic transport system (13), which uses recycled burnable gas as transport medium. The burnable gas thus generated corresponds in composition to a burnable gas which is formed at 800° to 900° C. in the gasification of the organic matter of the starting material with oxygen at atmospheric pressure. It is comparable to a gasification gas generated by the fluidized-bed gasification process, using an oxygen/steam mixture as gasification medium.

I claim:

1. A process for generating burnable gas from organic materials comprising:

drying the organic materials by direct or indirect supply of physical enthalpy to form dried materials, and subjecting said dried materials to low-temperature carbonization at 350° to 500° C., thereby effecting thermal decomposition into a carbonization gas comprising liquid hydrocarbons, steam, and coke, wherein said coke comprises carbon and an inorganic portion;

burning the carbonization gas with one or more of air, oxygen and oxygen-containing exhaust gases at temperatures above the melting temperature of said inorganic portion to form combustion gas, and removing molten inorganic portions;

converting the combustion gas into gasification gas by decreasing the gas temperature to 800° to 900° C., and blowing at least a portion of said coke, which has optionally been ground to form a pulverized fuel, into the combustion gas at 1200° to 2000° C., whereby said coke at least partially reduces carbon dioxide present to carbon monoxide, at least partially reduces said steam to hydrogen, and consumes heat;

processing the gasification gas, optionally after indirect and/or direct cooling, by dedusting and chemically cleaning said gasification gas to produce a burnable gas, and feeding dust containing carbon removed from said gasification gas to said burning step.

2. A process according to claim 1, wherein said enthalpy in said drying step is provided by enthalpy from said converting step and from said processing step.

3. A process according to claim 1, wherein said organic materials are selected from the group consisting of water-containing or ballast-containing materials.

4. A process according to claim 3, wherein said water-containing and ballast-containing materials are selected from the group consisting of coal, sludge, refuse, wood, and biomasses.

5. A process according to claim 1, wherein said organic materials have been previously comminuted.

6. A process according to claim 1, wherein the drying step is operated at atmospheric pressure.

7. A process according to claim 1, wherein solids in said carbonization gas formed in the drying step are separated using a screen.

8. A process according to claim 1, wherein said inorganic portion of the drying step is optionally removed by employing a further gas dedusting step.

9. A process according to claim 1, wherein the carbonization gas of the burning step is burnt in a slag-tap furnace.

10. A process according to claim 1, wherein the oxygen-containing exhaust gases are selected from the group consisting of exhaust gas from gas turbines and exhaust gas from internal combustion engines.

11. A process according to claim 1, wherein the melting temperature of the inorganic portion is in the range of 1200° to 2000° C.

12. A process according to claim 1, wherein the process occurs at a pressure of 1 to 50 bar.

13. A process according to claim 1, wherein said enthalpy in said drying step is provided by heat generated in said process itself.

* * * * *